US009841218B2

(12) United States Patent
Bauriedl

(10) Patent No.: US 9,841,218 B2
(45) Date of Patent: Dec. 12, 2017

(54) REFRIGERATION DEVICE COMPRISING AN ICE MAKER WITH A COUPLING

(71) Applicant: BSH HAUSGERAETE GMBH, Munich (DE)

(72) Inventor: Josef Bauriedl, Neunburg (DE)

(73) Assignee: BSH Hausgeraete GmbH, Munich (DE)

( * ) Notice: Subject to any disclaimer, the term of this patent is extended or adjusted under 35 U.S.C. 154(b) by 223 days.

(21) Appl. No.: 14/653,395

(22) PCT Filed: Dec. 13, 2013

(86) PCT No.: PCT/EP2013/076577
§ 371 (c)(1),
(2) Date: Jun. 18, 2015

(87) PCT Pub. No.: WO2014/095649
PCT Pub. Date: Jun. 26, 2014

(65) Prior Publication Data

US 2015/0330696 A1 Nov. 19, 2015

(30) Foreign Application Priority Data

Dec. 18, 2012 (DE) ..... 10 2012 223 632

(51) Int. Cl.
*F25C 5/18* (2006.01)
*F25C 5/00* (2006.01)
*F25C 5/04* (2006.01)

(52) U.S. Cl.
CPC ..... *F25C 5/182* (2013.01); *F25C 5/005* (2013.01); *F25C 5/046* (2013.01)

(58) Field of Classification Search
CPC ..... F25C 5/128; F25C 5/007
See application file for complete search history.

(56) References Cited

U.S. PATENT DOCUMENTS

| | | | | |
|---|---|---|---|---|
| 3,545,585 | A | 12/1970 | Eaton, Jr. | |
| 4,172,369 | A | 10/1979 | Hayes et al. | |
| 5,037,004 | A | 8/1991 | Katz et al. | |
| 5,273,219 | A | 12/1993 | Beach, Jr. et al. | |
| 8,151,594 | B2 * | 4/2012 | Kim | F25C 5/007 464/182 |
| 8,899,064 | B2 | 12/2014 | Hwang | |
| 2008/0011010 | A1 * | 1/2008 | Koons | F25C 5/005 62/344 |

FOREIGN PATENT DOCUMENTS

WO 2009078620 A2 6/2009

* cited by examiner

*Primary Examiner* — Cassey D Bauer
(74) *Attorney, Agent, or Firm* — Laurence A. Greenberg; Werner H. Stemer; Ralph E. Locher

(57) ABSTRACT

A refrigeration device has an ice maker with an ice cube container in which a conveying device for conveying the ice cubes is disposed. The conveying device is connected by way of a coupling to a drive of the ice maker for transmitting drive forces. The coupling is configured to transfer the drive forces of the drive to transform them partially into forces that are oriented towards the drive.

13 Claims, 4 Drawing Sheets

REFRIGERATION DEVICE COMPRISING AN ICE MAKER WITH A COUPLING

BACKGROUND OF THE INVENTION

Field of the Invention

The invention relates to a refrigeration appliance having an ice maker, which features an ice cube container, in which a conveying device for conveying ice cubes is arranged, the conveying device being connected to a drive of the ice maker by means of a coupling in such as manner as to transmit drive forces.

Refrigeration appliances, in particular refrigeration appliances configured as domestic appliances, are known and are used for household management in domestic situations or in the catering sector, in order to store perishable food and/or beverages at defined temperatures.

Such refrigeration appliances can feature an ice maker, which allows the preparation and dispensing of water ice cubes and/or crushed ice. The ice supplied by the ice maker is collected in an ice cube container, which is supported in a removable manner in an ice cube container holder of the ice maker. A coupling therefore connects a drive of the ice maker to a conveyor screw in the interior of an ice cube container, which can be used to convey ice cubes out of the interior of the ice cube container. However this can give rise to the problem that drive forces of the drive bring about a separation of the coupling, with the result that the ice cube container is pushed out of the ice cube container holder, thereby also causing the refrigeration appliance door of the refrigeration appliance to be opened in some instances. Humps which engage in the base of the ice cube container however require the ice cube container to be raised in order to be able to remove the ice cube container from the ice cube container support.

It is therefore the object of the invention to create a remedy for this.

BRIEF SUMMARY OF THE INVENTION.

This object is achieved by the subject matter having the features as claimed in the independent claim. Advantageous developments are the subject matter of the dependent claims, the description and the drawings.

The present invention is based on the knowledge that a self-securing configuration of the coupling can prevent the ice cube container being pushed out of the ice cube container holder.

According to one aspect the inventive object is achieved by a refrigeration appliance, in which the coupling is configured to convert drive forces of the drive to be transmitted partially to forces directed toward the drive. This has the technical advantage that tensile forces are generated by the coupling during the transmission of drive forces, said tensile forces ensuring that the coupling remains connected in such a manner as to transmit drive forces and no forces can act which act in the direction of a separation of the coupling and thus push the ice cube container out of the ice cube container holder.

A refrigeration appliance refers in particular to a domestic appliance, in other words a refrigeration appliance used for household management in domestic situations or in the catering sector, which serves in particular to store food and/or beverages at defined temperatures, for example a refrigerator, a freezer cabinet, a combined refrigerator/freezer, a chest freezer or a wine chiller cabinet.

In one advantageous embodiment a first contact surface of the coupling has a downward gradient, which is directed toward the drive in the direction of the axis of rotation of the drive. This has the technical advantage that the configuration of the contact surface with a downward gradient means that drive forces of the drive are partially converted to forces directed toward the drive.

In a further advantageous embodiment the first contact surface is configured as a flat surface. This has the technical advantage that the same proportion of drive force to be transmitted is converted to force directed toward the drive regardless of the contact point on the first contact surface.

In a further advantageous embodiment the downward gradient is at an angle of 3° to 5° to the axis of rotation. This has the technical advantage that the main proportion of the drive forces of the drive is transmitted by the coupling and only a minor proportion of the drive forces of the drive is used to secure the coupling, so the energy efficiency of the drive remains virtually unchanged.

In a further advantageous embodiment a second contact surface of the coupling has an upward gradient, which is directed toward the drive in the direction of the axis of rotation of the drive. This has the technical advantage that the second contact surface also converts drive forces and in the direction of the drive. Interaction of the first contact surface and the second contact surface can therefore improve the securing action of the coupling.

In a further advantageous embodiment the second contact surface is configured as a flat surface. This also has the advantage that the second contact surface converts the same proportion of the drive force of the drive to forces directed toward the drive regardless of the contact point.

In a further advantageous embodiment the upward gradient is at an angle of 3° to 5° to the axis of rotation. For example the downward gradient can be at the same angle as the upward gradient, so that, if the first contact surface and the second contact surface are configured as flat surfaces, the first contact and the second contact surface make full contact with one another, thereby ensuring particularly efficient force transmission. This has the technical advantage of providing an efficient coupling with compact dimensions.

In a further advantageous embodiment the coupling has a lead-in chamfer. This has the technical advantage that it is easy for a user to couple in the coupling as an ice cube container is inserted into an ice cube container holder.

In a further advantageous embodiment the lead-in chamfer is at an angle of 35° to 55°, in particular 40° to 50°, to the axis of rotation. This has the technical advantage of ensuring that it is particularly easy to establish the connection to the coupling when the ice cube container is introduced into the ice cube container holder of the ice maker.

In a further advantageous embodiment the coupling has two contact surface pairs. This has the technical advantage that two contact surface pairs, each consisting of two contact surfaces making contact, are available in a manner that transmits forces, so a particularly efficient and also compact coupling is provided.

In a further advantageous embodiment the contact surface pairs are arranged at equal distances in the peripheral direction of the axis of rotation. This has the technical advantage that the contact surface pairs, consisting of two contact surfaces, can come into contact alternately with the one or other contact surface respectively, so that it is easier to establish a coupling connection by introducing an ice cube container into the ice cube container holder of an ice maker.

In one advantageous embodiment a drive-side coupling segment of the coupling is made of a first material and a conveyor screw-side coupling segment of the coupling is made of a second material, both materials being different. This has the technical advantage that the coupling can operate particularly quietly as a result of the choice of the different materials.

In a further advantageous embodiment the drive-side coupling segment is made of metal and the conveyor screw-side coupling segment is made of plastic. For example the drive-side coupling segment can be made of steel and the conveyor screw-side coupling segment can be made of a thermoplastic, for example polyoxymethylene (POM). This has the technical advantage that both the drive-side coupling segment and the conveyor screw-side coupling segment can be made of materials that are readily available and easy to process.

According to a second aspect the inventive object is achieved by an ice maker for such a refrigeration appliance. This has the technical advantage that tensile forces are generated by the coupling during the transmission of drive forces, said tensile forces ensuring that the coupling remains connected in such a manner as to transmit drive forces and no forces can act which act in the direction of a separation of the coupling.

According to a third aspect the inventive object is achieved by a coupling for such a refrigeration appliance or for such an ice maker. This has the technical advantage that tensile forces are generated by the coupling during the transmission of drive forces, said tensile forces ensuring that the coupling remains connected in such a manner as to transmit drive forces and no forces can act which act in the direction of a separation of the coupling.

BRIEF DESCRIPTION OF THE SEVERAL VIEWS OF THE DRAWING

Further exemplary embodiments are described with reference to the accompanying drawings, in which.

DESCRIPTION OF THE INVENTION

Figure 1:
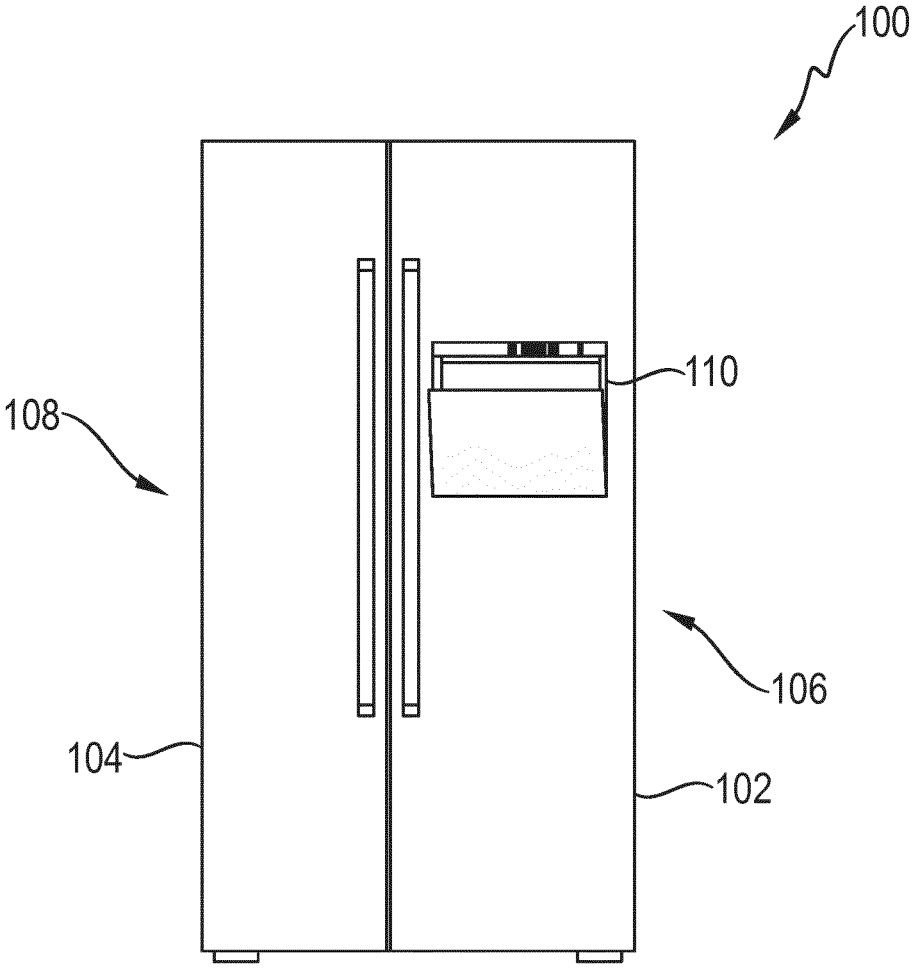
FIG. 1 shows a front view of a refrigeration appliance.

FIG. 1 shows an exemplary embodiment of a refrigeration appliance 100 in the form of a refrigerator, having a right refrigeration appliance door 102 and a left refrigeration appliance door 104 on its refrigeration appliance front face. The refrigerator serves for example to chill food and comprises a refrigerant circuit having an evaporator (not shown), a compressor (not shown), a condenser (not shown) and a throttle device (not shown).

The evaporator is configured as a heat exchanger, in which after expansion the liquid refrigerant is evaporated by absorbing heat from the medium to be cooled, in other words air in the interior of the refrigerator.

The compressor is a mechanically driven component, which takes in refrigerant vapor from the evaporator and ejects it to the condenser at a higher pressure.

The condenser is configured as a heat exchanger, in which after compression the evaporated refrigerant is condensed by emitting heat to an external cooling medium, in other words the ambient air.

The throttle device is an apparatus for constantly reducing the pressure by cross section reduction.

The refrigerant is a fluid used for heat transmission in the cold-generating system, which absorbs heat when the fluid is at low temperatures and low pressure and emits heat when the fluid is at a higher temperature and higher pressure, with state changes of the fluid generally being included.

The right refrigeration appliance door can be used to open a right refrigeration compartment 106, which is configured as a refrigeration compartment in the present exemplary embodiment. The left refrigeration appliance door 104 can be used to open a left refrigeration compartment 108, which is configured as a chiller compartment in the present exemplary embodiment.

Arranged in the right refrigeration compartment 106 is an ice maker 110, which in the present exemplary embodiment prepares ice cubes from water and also supplies crushed ice. Ice cubes and/or crushed ice can be dispensed through the right refrigeration appliance door 102 at the refrigeration appliance front face without the right refrigeration appliance door 102 having to be opened.

Figure 2:
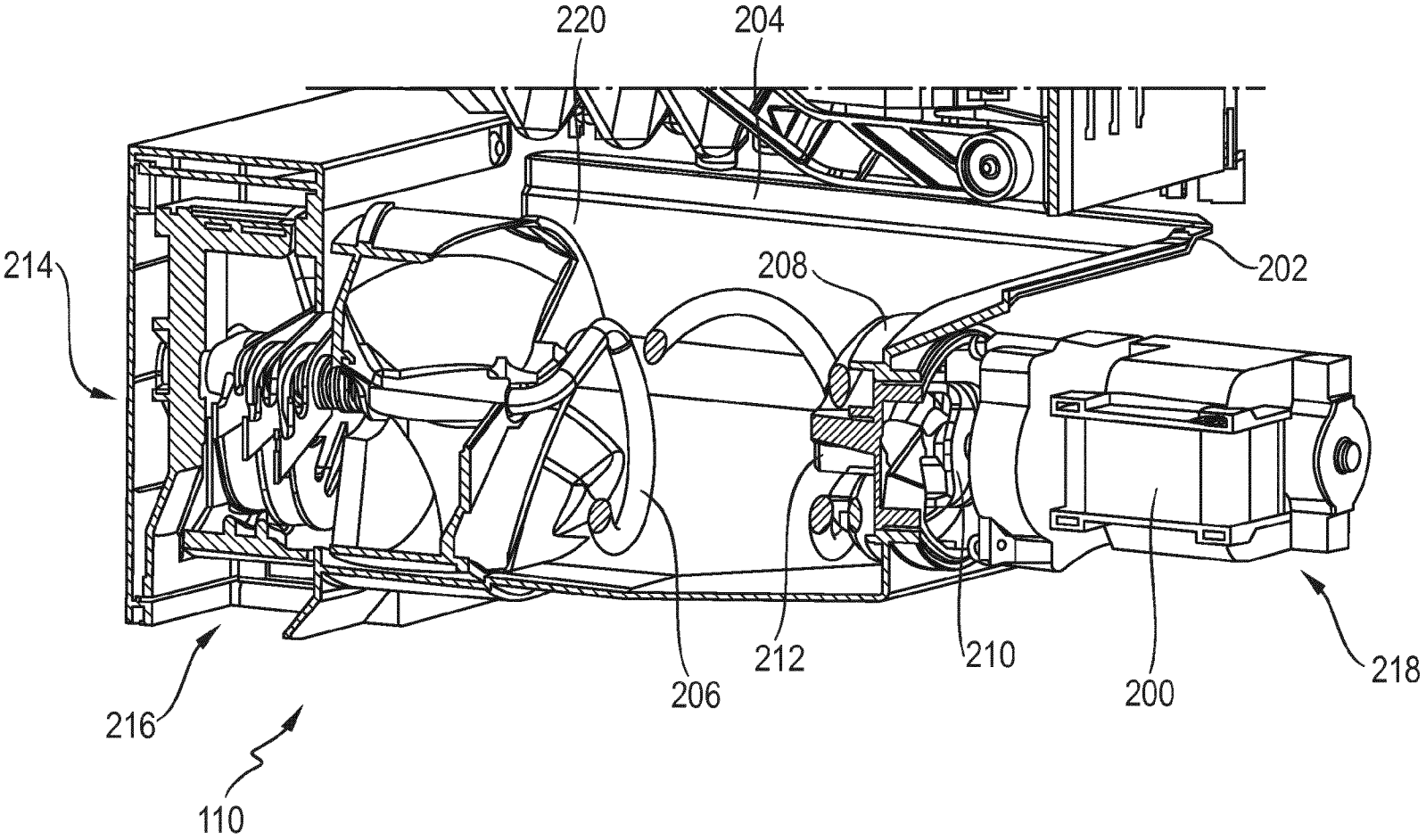
FIG. 2 shows a perspective representation of an ice maker.

FIG. 2 shows the ice maker 110.

In the present exemplary embodiment the ice maker 110 features an ice cube container 202, in which ice cubes are collected. In the present exemplary embodiment the ice cube container 202 is made of plastic. The ice cube container 202 is inserted into an ice cube container holder 218 of the ice maker 110.

Arranged in the interior space 204 of the ice cube container 202 is a conveying device 206, which can be used to convey the ice cubes in the interior of an ice cube container 202 to a dispensing opening 220 of the ice cube container 202. In the present exemplary embodiment the conveying device 206 is configured as a conveyor screw. A drive 200 is provided to drive the conveying device 206, being formed by an electric motor in the present exemplary embodiment.

The action of the conveying device 206 allows ice cubes to be supplied to an ice crusher 214 through the dispensing opening 220, said ice crusher 214 crushing the ice cubes so that crushed ice can also be dispensed through the ice dispensing opening 216.

The ice cube container 202 is supported in a removable manner in the ice cube container holder 218. A coupling 208 is provided, which connects the drive 200 to the conveying device 206 to transmit drive forces of the drive 200 to the conveying device 206 and allows separation of the drive 200 from the conveying device 206 when the ice cube container 202 is removed from the ice cube container holder 218.

In the present exemplary embodiment the coupling 208 comprises a drive-side coupling segment 210 and a conveyor screw-side coupling segment 212.

In the present exemplary embodiment the drive-side coupling segment 210 is made of metal, e.g. steel, while the conveyor screw-side coupling segment 212 is made of a thermoplastic, for example polyoxymethylene (POM).

Figure 3:
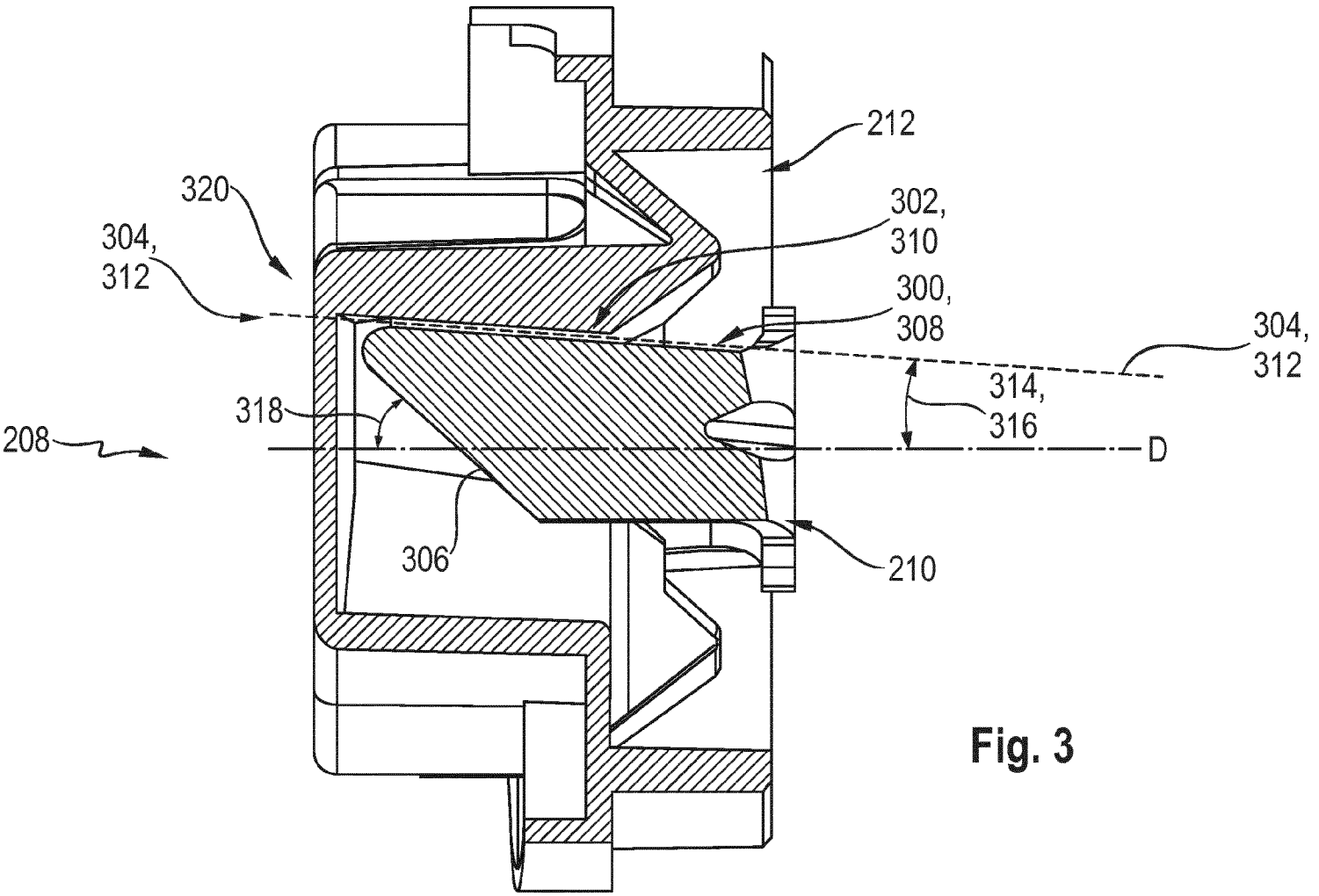
FIG. 3 shows a section through a coupling of the ice maker.

FIG. 3 shows the coupling 208 with the drive-side coupling segment 210 and the conveyor screw-side coupling segment 212 in cross section.

In the present exemplary embodiment the drive-side coupling segment 210 has a first contact surface 300, which is configured as a flat surface 308 in the present exemplary embodiment.

In the present exemplary embodiment the flat surface 308 has a downward gradient 304 in the representation shown in FIG. 3, running at an angle 314 to the axis of rotation D of the drive 200 in the present exemplary embodiment. The angle 314 can be within a range from 3° to 5° for example. In the present exemplary embodiment the angle 314 is 4°.

The drive-side coupling segment 210 in the present exemplary embodiment also has a lead-in chamfer 306. In the present exemplary embodiment the lead-in chamfer 306 runs at an angle 318 to the axis of rotation D. The angle 318 can be within a range from 35° to 55° for example, in particular in a range from 40° to 50°. In the present exemplary embodiment the angle 318 is 45°.

The conveyor screw-side coupling segment 212 has a second contact surface 302, which is also configured as a flat surface 310 in the present exemplary embodiment. In the present exemplary embodiment the flat surface 310 runs at an angle 316 to the axis of rotation D of the drive 200. The angle 316 can be within a range from 3° to 5° for example. In the present exemplary embodiment the angle 316 is 4°.

Therefore in the present exemplary embodiment the flat surface 308 and the flat surface 310 are at the same angle to the axis of rotation D and make full contact with one another as a result of their flat configuration.

They therefore form one of two contact surface pairs 320 in the present exemplary embodiment.

The downward gradient angle 314 of the first contact surface 300 or the upward gradient angle 316 of the second contact surface 302 means that when the coupling 208 is closed, part of the drive force of the drive 200 is converted to a force which draws the conveyor-side coupling segment 212 in the direction of the drive 200. The coupling 208 therefore secures itself automatically during operation, thereby preventing the ice cube container 202 being pushed away from the ice cube container holder 218 of the ice maker 110 along the direction of extension of the axis of rotation D by the drive 200, with the result that the ice cube container 202 pushes the right refrigeration appliance door 102.

Figure 4:
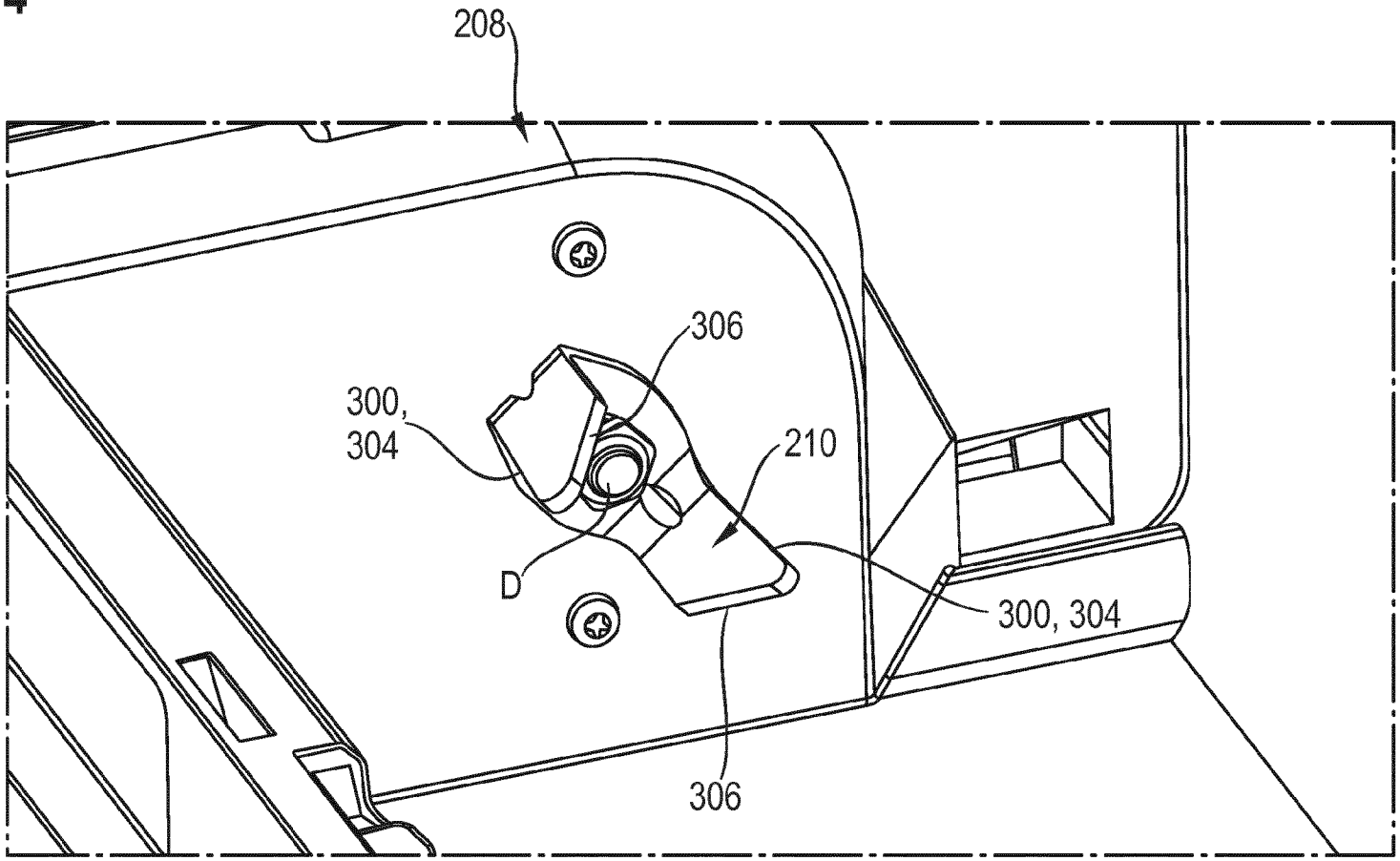
FIG. 4 shows a perspective representation of a drive-side coupling segment of the coupling.

FIG. 4 shows that the drive-side coupling segment 210 has two first contact surfaces 300 and two lead-in chamfers 306 in each instance. The two first contact surfaces 300 in each instance in the present exemplary embodiment are at equal distances in the peripheral direction of the axis of rotation D. Therefore in each instance only a 180° rotation of the drive-side coupling segment 210 or of the conveyor screw-side coupling segment 212 is required to couple in the coupling 208, thereby simplifying coupling in.

Thus in the present exemplary embodiment the two first contact surfaces 300 of the drive-side coupling segment 210 and two second contact surfaces 302 of the conveyor screw-side coupling segment 212, which are also at equal distances in the peripheral direction of the axis of rotation D, form the two contact surface pairs 320 and thereby ensure reliable transmission of the drive forces of the drive 200 to the conveying device 206.

LIST OF REFERENCE CHARACTERS

100 Refrigeration appliance
102 Right refrigeration appliance door
104 Left refrigeration appliance door
106 Right refrigeration compartment
108 Left refrigeration compartment
110 Ice maker
200 Drive
202 Ice cube container
204 Interior space
206 Conveying device
208 Coupling
210 Drive-side coupling segment
212 Conveyor screw-side coupling segment
214 Ice crusher
216 Ice dispensing opening
218 Ice cube container holder
220 Dispensing opening
300 First contact surface
302 Second contact surface
304 Downward gradient
306 Lead-in chamfer
308 Flat surface
310 Flat surface
312 Upward gradient
314 Angle
316 Angle
318 Angle
320 Contact surface pair
D Axis of rotation

The invention claimed is:

1. A refrigeration appliance, comprising:

an ice maker having an ice cube container and a conveyor for conveying ice cubes arranged in said ice cube container; and said ice maker having a drive and a coupling connecting said conveyor to said drive in a force-transmitting relationship, said drive having an axis of rotation and said coupling having a first contact surface with a downward gradient, directed toward said drive in a direction of said axis of rotation;

said first contact surface with said downward gradient converting drive forces of said drive to be transmitted partially into forces directed toward said drive.

2. The refrigeration appliance according to claim 1, wherein said first contact surface is a planar surface.

3. The refrigeration appliance according to claim 1, wherein said downward gradient encloses an angle of 3° to 5° with said axis of rotation of said drive.

4. The refrigeration appliance according to claim 1 wherein said coupling has a second contact surface with an upward gradient, directed toward said drive in the direction of said axis of rotation of said drive.

5. The refrigeration appliance according to claim 4, wherein said second contact surface is a planar surface.

6. The refrigeration appliance according to claim 4, wherein said upward gradient encloses an angle of 3° to 5° with said axis of rotation of said drive.

7. The refrigeration appliance according to claim 1, wherein said coupling is formed with a lead-in chamfer.

8. The refrigeration appliance according to claim 7, wherein said lead-in chamfer encloses an angle of 35° to 55° with an axis of rotation of said drive.

9. The refrigeration appliance according to claim 7, wherein said lead-in chamfer encloses an angle of 40° to 50° with an axis of rotation of said drive.

10. The refrigeration appliance according to claim 1, wherein said coupling is formed with two contact surface pairs.

11. The refrigeration appliance according to claim 10, wherein said contact surface pairs are arranged at equal distances in a circumferential direction of an axis of rotation of said drive.

12. The refrigeration appliance according to claim 1, wherein said coupling has a drive-side coupling segment facing toward said drive and a conveyor screw-side coupling segment facing toward a conveyor screw of said conveyor, and wherein said drive-side coupling segment is formed of a first material and said conveyor screw-side coupling segment is formed of a second material, different from said first material.

13. The refrigeration appliance according to claim 12, wherein said drive-side coupling segment is made of metal and said conveyor screw-side coupling segment is made of plastic.

* * * * *